US006871922B1

(12) United States Patent
Pustilnikov

(10) Patent No.: US 6,871,922 B1
(45) Date of Patent: Mar. 29, 2005

(54) ROTATING SHELF ASSEMBLY

(76) Inventor: Feliks Pustilnikov, 5 Pelican Ct., Palm Coast, FL (US) 32137

( * ) Notice: Subject to any disclaimer, the term of this patent is extended or adjusted under 35 U.S.C. 154(b) by 85 days.

(21) Appl. No.: 10/281,040

(22) Filed: Oct. 28, 2002

(51) Int. Cl.[7] ..... A47B 91/00
(52) U.S. Cl. ..... 312/351.14; 108/42; 312/202
(58) Field of Search ..... 312/351.14, 198, 312/207, 202, 244, 324; 108/42, 64

(56) References Cited

U.S. PATENT DOCUMENTS

| | | | | | |
|---|---|---|---|---|---|
| 275,616 | A | * | 4/1883 | Elward | 312/200 |
| 842,669 | A | * | 1/1907 | Hughes | 312/198 |
| 1,242,916 | A | * | 10/1917 | Brooks | 312/201 |
| 1,980,730 | A | | 11/1934 | Matchette | |
| 2,200,934 | A | | 5/1940 | Platt et al. | |
| 2,589,370 | A | | 3/1952 | Grennan | |
| 2,944,863 | A | | 7/1960 | Bertelsen | |
| 3,207,566 | A | | 9/1965 | Grieco | |
| 3,596,297 | A | * | 8/1971 | James | 312/198 |
| 3,869,183 | A | | 3/1975 | Frank | |
| 4,738,495 | A | | 4/1988 | Mitts | |
| 4,979,785 | A | * | 12/1990 | Richards | 312/201 |
| 5,460,280 | A | | 10/1995 | Feddeler | |
| D369,250 | S | * | 4/1996 | Palmer et al. | D6/434 |
| 5,749,636 | A | * | 5/1998 | Boury | 312/201 |
| 6,375,285 | B1 | * | 4/2002 | Choi | 312/202 |
| 6,457,278 | B1 | * | 10/2002 | Fleming | 312/326 |

FOREIGN PATENT DOCUMENTS

| | | | | |
|---|---|---|---|---|
| DE | 3513000 | * | 10/1986 | 312/198 |

* cited by examiner

*Primary Examiner*—Lanna Mai
*Assistant Examiner*—Hanh V Tran
(74) *Attorney, Agent, or Firm*—Paul S. Rooy, P.A.

(57) ABSTRACT

A rotating shelf assembly having at least one rotating shelf array rotatabiy mounted to a base closet. Each rotating shelf array has a rotating shelf array top, rotating shelf array floor, rotating shelf array side wall, rotating shelf array flat back, rotating shelf array curved back, and adjustable shelves. Edges of the rotating shelf array top, rotating shelf array floor, rotating shelf array floor and rotating shelf array curved back define a rotating shelf array mouth, through which the adjustable shelves may be accessed. Each rotating shelf array is rotatably attached to a base closet. The storage closet may have storage closet doors to permit access to items stored behind the base closet. Alternate embodiments include a rotating shelf array sized to be mounted to a storage room wall step, and a clam-shell rotating shelf array designed to be mounted to a flat wall.

10 Claims, 10 Drawing Sheets

ROTATING SHELF ASSEMBLY

BACKGROUND OF THE INVENTION

1. Field of the Invention

This invention relates to storage systems, and in particular to a space-saving floor or wall mounted rotating shelf assembly.

2. Background of the Invention

Since the dawn of human housing, storage rooms have existed. They are used to store different items which are not required for day-to-day living. Modern examples of storage rooms include garages and dedicated storage rooms in houses.

One problem associated with storage rooms is the tendency of the items to be stored to languish on the floor of the storage room itself, as well as to cover every available horizontal surface. This entropic layer of miscellany is not only unsightly, but can also actually be a safety hazard, if an individual were to trip and fall over some item left on the floor. Each year falls constitute a significant portion of the injuries incurred by our population, so the problem is serious. Therefore, it would be beneficial to provide a storage system which would keep items being stored off the floor, to prevent them from being stepped on or tripped over.

Another problem associated with storage rooms in general is the lack of organization associated with the wide variety of items stored in them. It would be desirable to provide a storage system which would facilitate keeping stored-items organized, in order to make them readily available and easily found when needed.

Still another problem associated with modem storage rooms and garages is the tendency of stored items to deteriorate over time. This could be due to dust settling,on them, cars being driven over them, or even by people stepping on them or tripping over them. Thus, it would be desirable to provide a storage means which protects the items being stored from damage.

SUMMARY OF THE INVENTION

Accordingly, it is an object of the present invention to provide a rotating shelf assembly which keeps items being stored off the storage room floor. Design features allowing this object to be accomplished include at least one rotating shelf array having a plurality of adjustable shelves. Advantages associated with the accomplishment of this object include reduced injury to individuals tripping over, or stepping on, the items being stored, as well as avoidance of damage to the items being stored themselves.

It is another object of the present invention to provide a rotating shelf assembly which facilitates organization of the items being stored. Design features allowing this object to be accomplished include at least one rotating shelf array having a plurality of adjustable shelves. A benefit associated with the accomplishment of this object is rendering the items being stored readily available and easily found when needed.

It is yet another object of this invention to provide a rotating shelf assembly which is easily manufactured and installed. Design features allowing this object to be achieved include the use of components and materials available off-the-shelf, or made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Ten sheets of drawings are provided. Sheet one contains FIG. 1. Sheet two contains FIG. 2. Sheet three contains FIG. 3. Sheet four contains FIG. 4. Sheet five contains FIG. 5. Sheet six contains FIG. 6. Sheet seven contains FIGS. 7 and 8. Sheet eight contains FIG. 9. Sheet nine contains FIG. 10. Sheet ten contains FIGS. 11 and 12.

DETAILED DESCRIPTION OF THE PREFERRED EMBODIMENT

Figure 1:
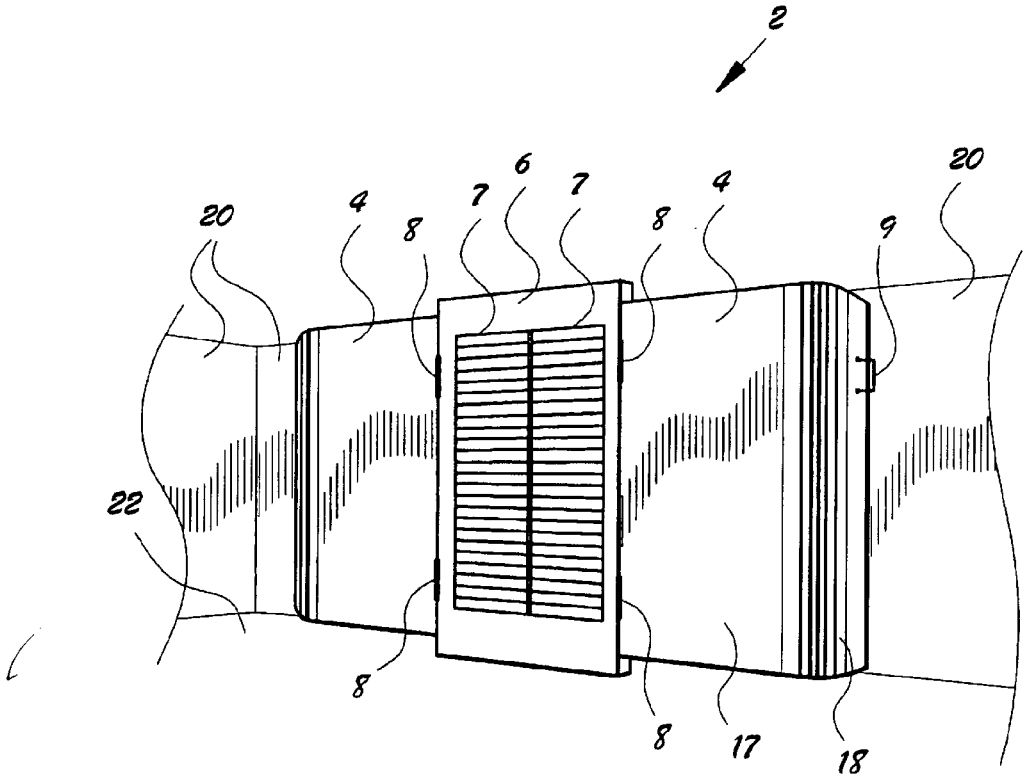
FIG. 1 is a front isometric view, of a rotating shelf assembly incorporating two rotating shelf arrays, each in the closed position.

FIG. 1 is a front isometric view of rotating shelf assembly 2 incorporating two rotating shelf arrays 4, each in the closed position. Each rotating shelf array 4 is rotatably attached to base closet 6 by means of hinges 8. Base closet 6 may comprise at least one base door 7, through which utility appliances such as air conditioner equipment, heating equipment, hot water heater, etc. may be accessed. Thus, base closet 6 serves not only as a support for rotating shelf arrays 4, but also as a screen to hide unsightly equipment which is frequently installed in garages and/or storage rooms.

Figure 2:
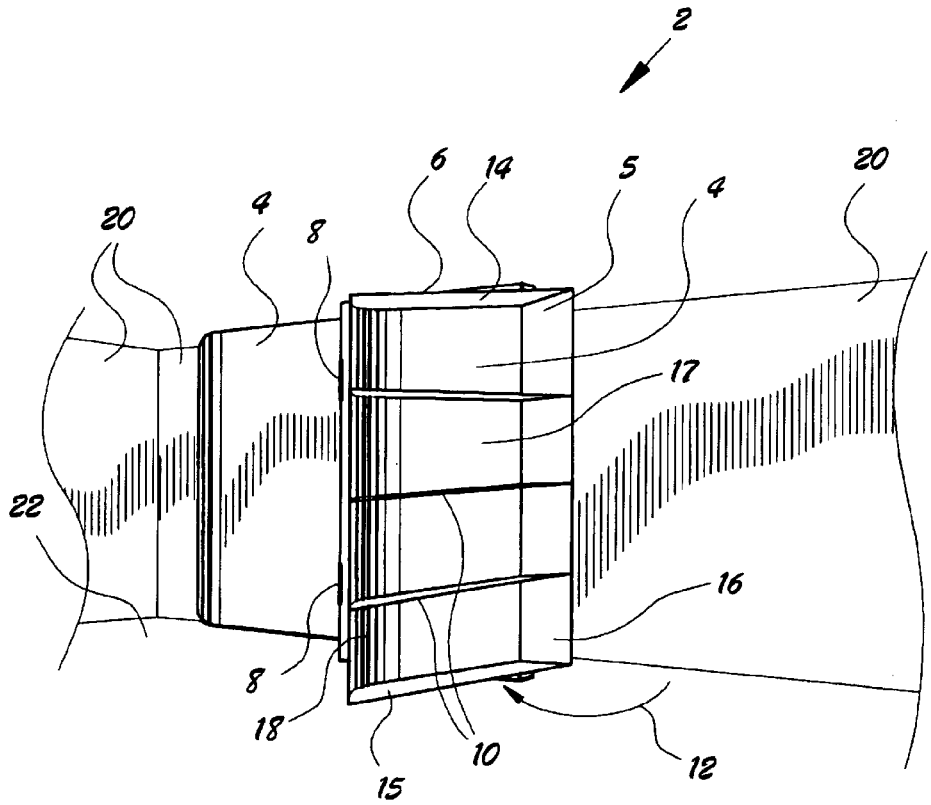
FIG. 2 is a front isometric view of a rotating shelf assembly with one rotating shelf array in the open position, and one rotating shelf array in the closed position.

FIG. 2 is a font isometric view of rotating shelf assembly 2 with one rotating shelf array 4 in the open position, and the other rotating shelf array 4 in the closed position. The open rotating shelf array 4 has been swung open as indicated by arrow 12 in FIG. 2. Items being stored within the open rotating shelf array 4 may be accessed through rotating shelf array mouth 5.

Rotating shelf array 4 comprises rotating shelf array top 14, rotating shelf array floor 15, rotating shelf array side wall 16, rotating shelf array flat back 17, rotating shelf array curved back 18, and adjustable shelves 10. The position of adjustable shelves 10 may be adjusted relative to rotating shelf array floor 15, rotating shelf array top 14, and each other, in order to accommodate differently sized items to be stored on them and on rotating shelf array floor 15. Handle 9 may be disposed on rotating shelf array curved back 18 opposite hinges 8, to facilitate opening and closing rotating shelf array 4.

Rotating shelf array side wall 16 and rotating shelf array curved back 18 are disposed at opposite vertical edges of rotating shelf array flat back 17 from each other. Rotating shelf array floor 15 is attached to the lower edges of rotating shelf array side wall 16, rotating shelf array flat back 17 and rotating shelf array curved back 18. Rotating shelf array top 14 is attached to the upper edges of rotating shelf array side wall 16, rotating shelf array flat back 17 and rotating shelf array curved back 18. Rotating shelf array mouth 5 is defined by the edges opposite rotating shelf array flat back 17 of rotating shelf array top 14, rotating shelf array side wall 16, rotating shelf array curved back 18 and rotating shelf array floor 15.

Figure 3:
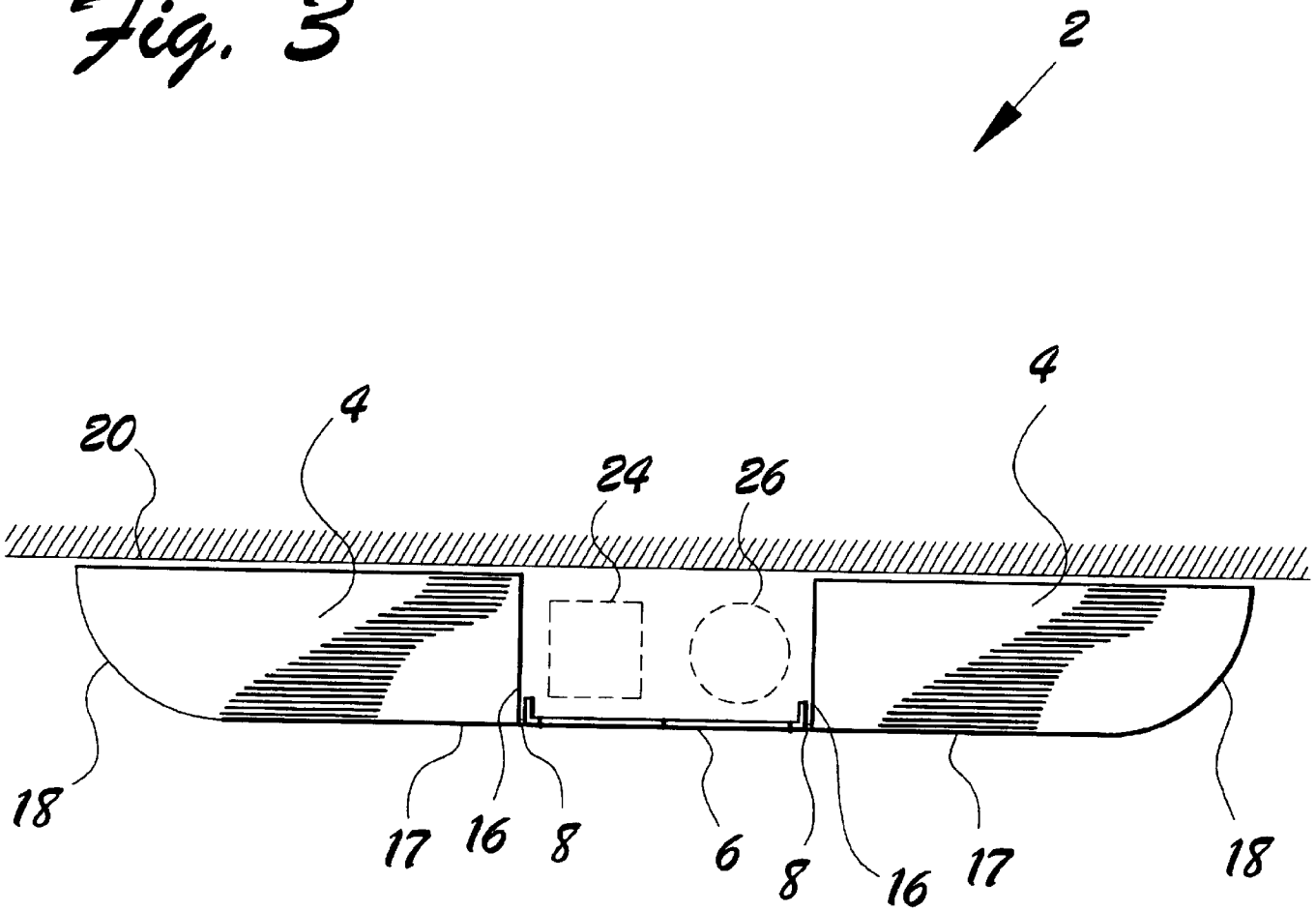
FIG. 3 is a top view of a rotating shelf assembly incorporating two rotating shelf arrays, each in the closed position.

FIG. 3 is a top view of rotating shelf assembly 2 incorporating two rotating shelf arrays 4, each in the closed position. The rotating shelf arrays 4 are rotatably attached, via hinges 8 to opposite vertical edges of base closet 6 at the intersection of their respective rotating shelf array side walls 16 and rotating shelf array flat backs 17. This location of the hinged attachment between rotating shelf array 4 and base closet 6 permits rotating shelf array 4 to swing wide open for easy accessibility of adjustable shelves 10, as indicated by arrow 28 in FIG. 4.

Figure 4:
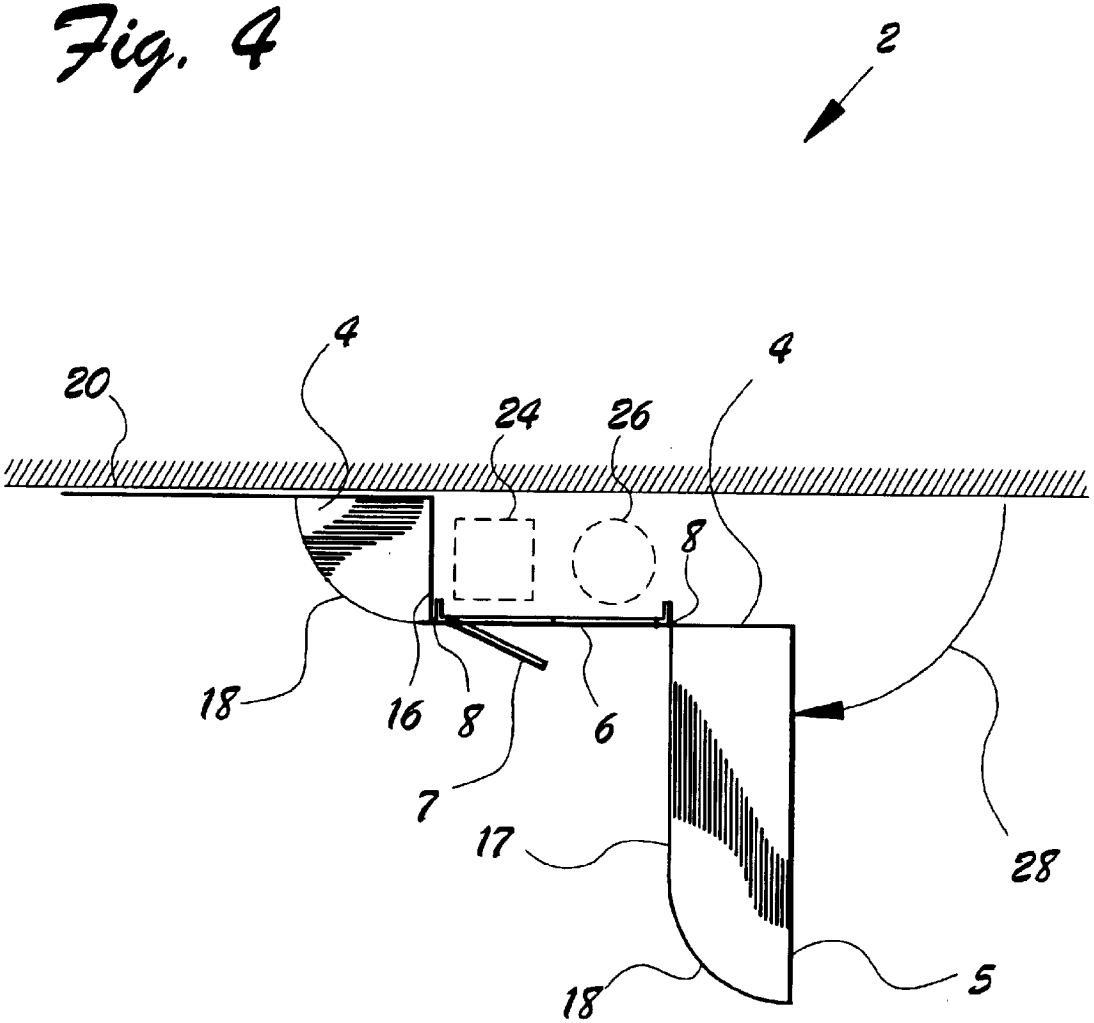
FIG. 4 is a top view of a rotating shelf assembly incorporating two rotating shelf arrays, one in the open position and one in the closed position.

FIG. 4 additionally depicts a base closet door 7 in an open position, to access utility appliances which may be located behind base closet 6. Existing air conditioning equipment 24 and hot water heater 16 are depicted in FIGS. 3 and 4 in ghost lines.

The top view shape of rotating shelf array curved back 18 is substantially an arc of a circle extending 90 degrees. As may be observed in FIG. 4, the width of rotating shelf array flat back 17 may vary from wide, as shown in the right rotating shelf array 4 depicted in FIG. 4, to narrow, as shown in the left rotating shelf array 4 depicted in FIG. 4.

Base closet 6 rests on storage room floor 22, and may be attached to the ceiling of the storage room for stability. The entire rotating shelf assembly 2 is positioned flush against storage room wall 20 for economy of space. The curved shape of rotating shelf array curved backs 18 affords rotating shelf assembly 2 a sleek, streamlined appearance, and further contributes to the space-saving, small-footprint function and visual impression of rotating shelf assembly 2.

FIGS. 5–8 depict an alternate embodiment rotating shelf assembly 2 designed to fit into a storage room wall step 21. The rotating shelf array side wall 16 width is sized to be substantially equal to the width of storage room wall step 21. Thus, the alternate embodiment rotating shelf assembly 2 depicted in FIGS. 5–8 nests neatly against storage room wall step 21, and the combination of rotating shelf array flat back 17 and rotating shelf array curved back 18 affords a streamlined, space-saving look to the installation.

Figure 5:
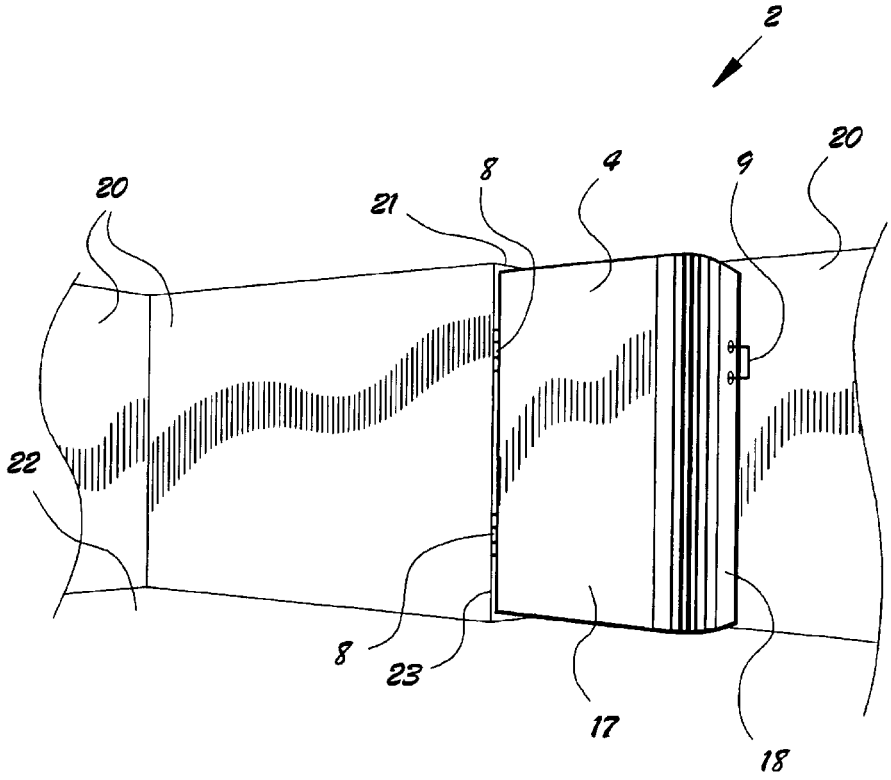
FIG. 5 is a front isometric view of an alternate embodiment rotating shelf assembly incorporating one rotating shelf array in the closed position, mounted at a storage room wall step lip.

FIG. 5 is a front isometric view of rotating shelf assembly 2 incorporating one rotating shelf array 4 in the closed position. Rotating shelf array 4 is rotatably attached to storage room wall step lip 23 by means of hinges 8.

Figure 6:
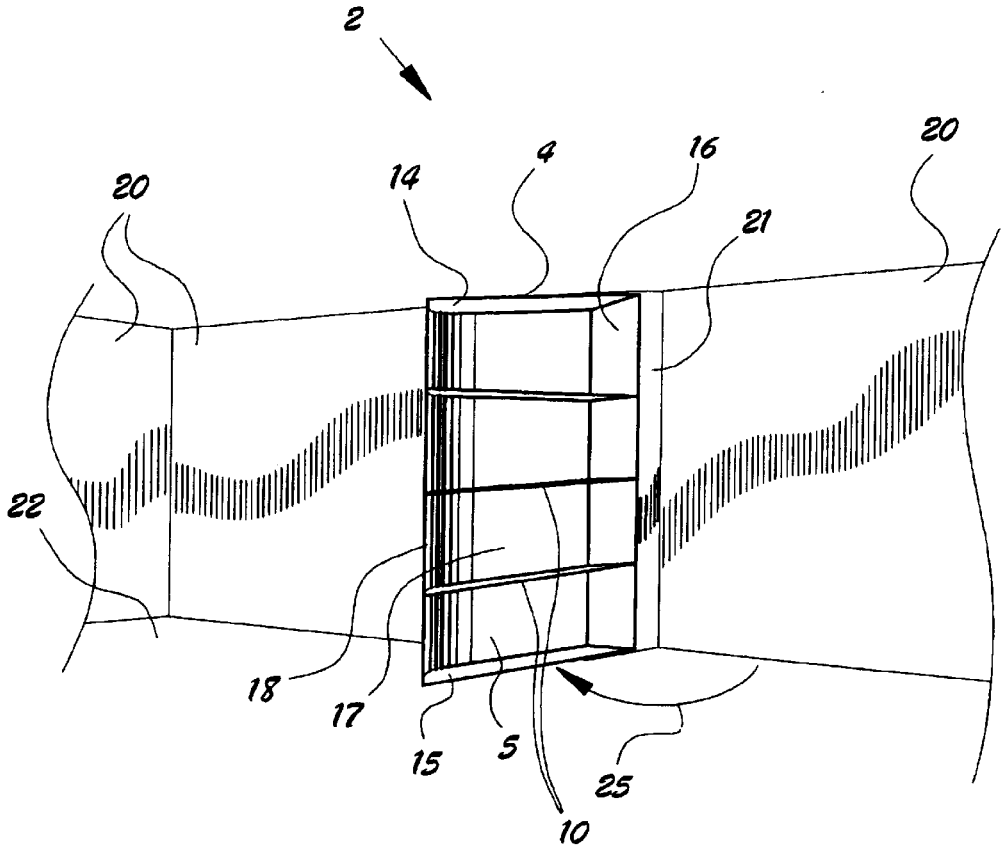
FIG. 6 is a front isometric view of an alternate embodiment rotating shelf assembly incorporating one rotating shelf array in the open position, mounted at a storage room wall step lip.

FIG. 6 is a front isometric view of rotating shelf array 4 in the open position. Rotating shelf array 4 has been swung open as indicated by arrow 25 in FIG. 6. Items being stored within open rotating shelf array 4 may be accessed through rotating shelf array mouth 5.

Rotating shelf array 4 comprises rotating shelf array top 14, rotating shelf array floor 15, rotating shelf array side wall 16, rotating shelf array flat back 17, rotating shelf array curved back 18, and adjustable shelves 10. The position of adjustable shelves 10 may be adjusted relative to rotating shelf array floor 15, rotating shelf array top 14, and each other, in order to accommodate differently sized items to be stored on them and on rotating shelf array floor 15. Handle 9 may be disposed on rotating shelf array curved back 18 opposite hinges 8, to facilitate opening and closing rotating shelf array 4.

Rotating shelf array side wall 16 and rotating shelf array curved back 18 are disposed at opposite vertical edges of rotating shelf array flat back 17 from each other. Rotating shelf array floor 15 is attached to the lower edges of rotating shelf array side wall 16, rotating shelf array flat back 17 and rotating shelf array curved back 18. Rotating shelf array top 14 is attached to the upper edges of rotating shelf array side wall 16, rotating shelf array flat back 17 and rotating shelf array curved back 18. Rotating shelf array mouth 5 is defined by the edges opposite rotating shelf array flat back 17 of rotating shelf array top 14, rotating shelf array side wall 16, rotating shelf array curved back 18 and rotating shelf array floor 15.

Figure 7:
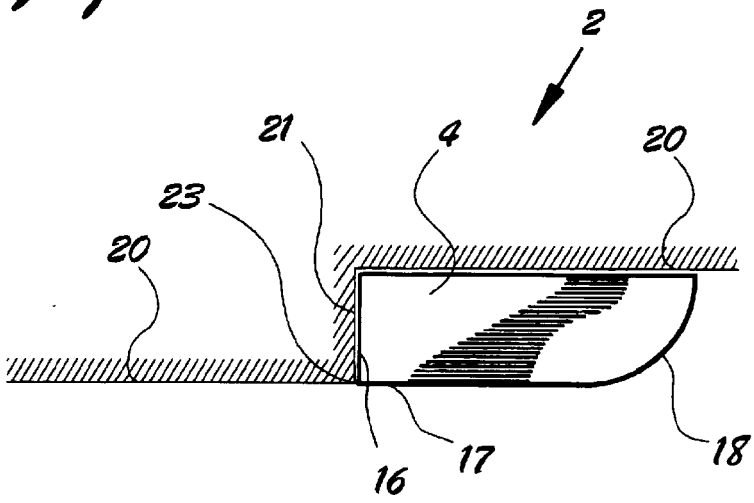
FIG. 7 is a top view of an alternate embodiment rotating shelf assembly incorporating one rotating shelf array in the closed position, mounted at a storage room wall step lip.
Figure 8:
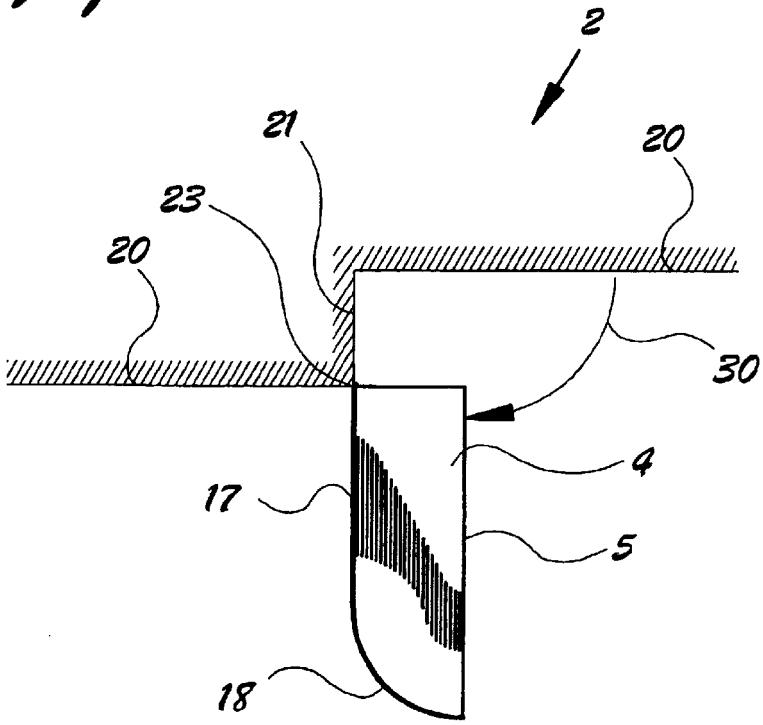
FIG. 8 is a top view of an alternate embodiment rotating shelf assembly incorporating one rotating shelf array in the open position, mounted at a storage room wall step lip.

FIG. 7 is a top view of rotating shelf array 4 in the closed position. Rotating shelf array 4 is rotatably attached via hinges 8 to storage room wall step lip 23 at the intersection of rotating shelf array side wall 16 and rotating shelf array flat back 17. This location of the hinged attachment between rotating shelf array 4 and storage room wall step lip 23 permits rotating shelf array 4 to swing wide open for easy accessibility of adjustable shelves 10, as indicated by arrow 30 in FIG. 8.

The top view shape of rotating shelf array curved back 18 is substantially an arc of a circle extending 90 degrees. Rotating shelf array 2 is positioned flush against storage room wall 20 and storage room wall step 21 for economy of space. The curved shape of rotating shelf array curved back 18 affords rotating shelf assembly 2 a sleek, streamlined appearance, and further contributes to the space-saving, small-footprint function and visual impression of rotating shelf assembly 2.

FIGS. 9–12 depict an alternate embodiment rotating shelf assembly 2 comprising clam-shell rotating shelf array 4. Clam-shell rotating shelf array 4 is designed to be rotatably mounted to a flat storage room wall 20, and by virtue of its two, oppositely disposed rotating shelf array curved backs 18, to nest neatly against storage room wall 20. The rotating shelf array curved backs 18, attached to opposite vertical edges of rotating shelf array flat back 17 affords a streamlined, space-saving look to the installation.

Figure 9:
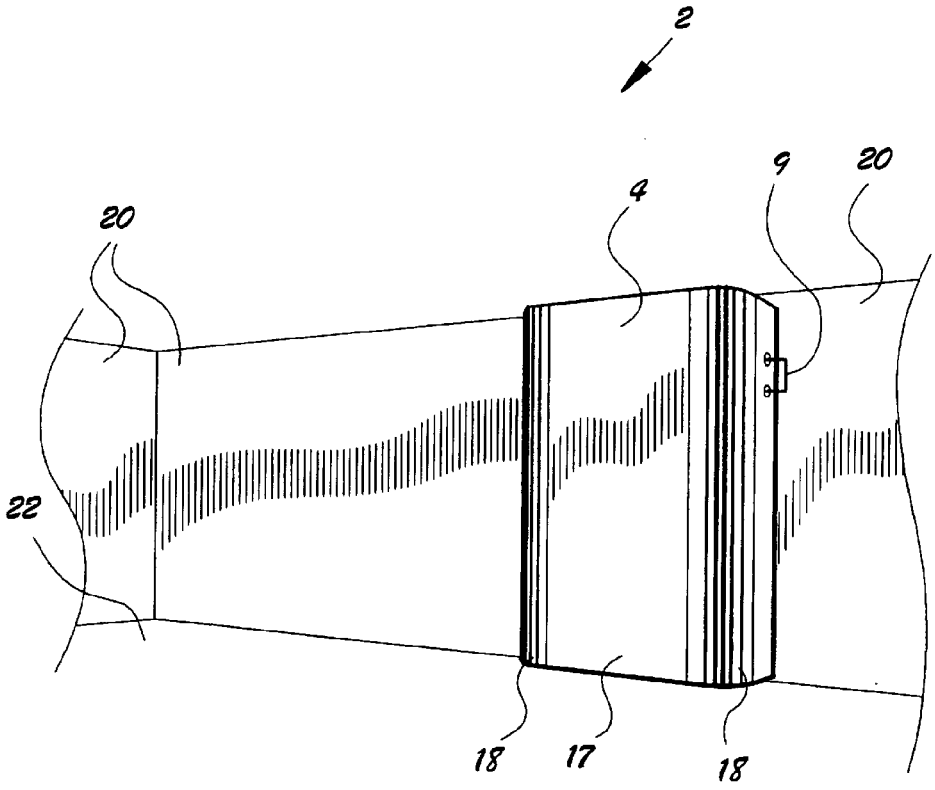
FIG. 9 is a front isometric view of an alternate embodiment rotating shelf assembly incorporating a clam-shell rotating shelf array in the closed position, mounted to a wall.

FIG. 9 is a front isometric view of rotating shelf assembly 2 incorporating one rotating shelf array 4 in the closed position. Rotating shelf array 4 is rotatably attached to storage room wall 20 by means of hinges 8, visible in FIG. 10.

Figure 10:
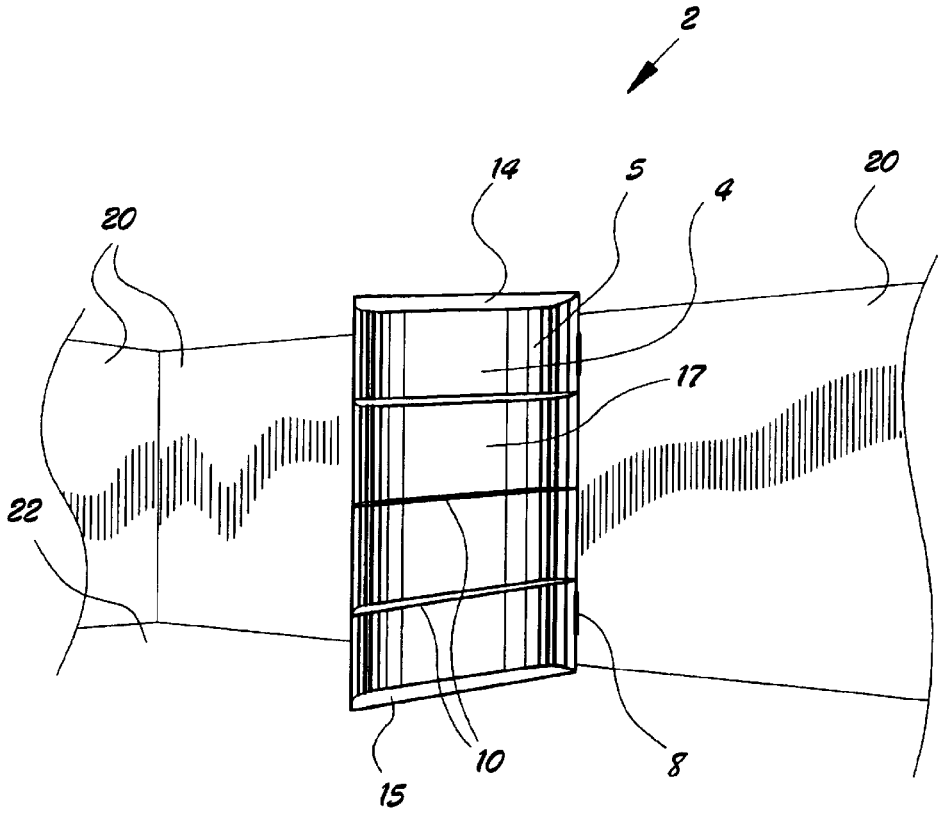
FIG. 10 is a front, isometric view of an alternate embodiment rotating shelf assembly incorporating a clan-shell rotating shelf array in the open position, mounted to a wall.

FIG. 10 is a front isometric view of rotating shelf array 4 in the open position. Rotating shelf array 4 has been swung open as indicated by arrow 32 in FIG. 12. Items being stored within open rotating shelf array 4 may be accessed through rotating shelf array mouth 5.

Rotating shelf array 4 comprises rotating shelf array top 14, rotating shelf array floor 15, rotating shelf array flat back 17, a rotating shelf array curved back 18 attached to each of the two opposite vertical edges of shelf array flat back 17, and adjustable shelves 10. The position of adjustable shelves 10 may be adjusted relative to rotating shelf array floor 15, rotating shelf array top 14, and each other, in order to accommodate differently sized items to be stored on them and on rotating shelf array floor 15. Handle 9 may be disposed on rotating shelf array curved back 18 opposite hinges 8, to facilitate opening and closing rotating shelf array 4.

The two rotating shelf array curved backs 18 are disposed at opposite vertical edges of rotating shelf array flat back 17. Rotating shelf array floor 15 is attached to the lower edges of rotating shelf array flat back 17 and rotating shelf array curved backs 18. Rotating shelf array top 14 is attached to the upper edges of rotating shelf array flat back 17 and rotating shelf array curved backs 18. Rotating shelf array mouth 5 is defined by the edges opposite rotating shelf array flat back 17 of rotating shelf array top 14, rotating shelf array curved backs 18 and rotating shelf array floor 15.

Figure 11:
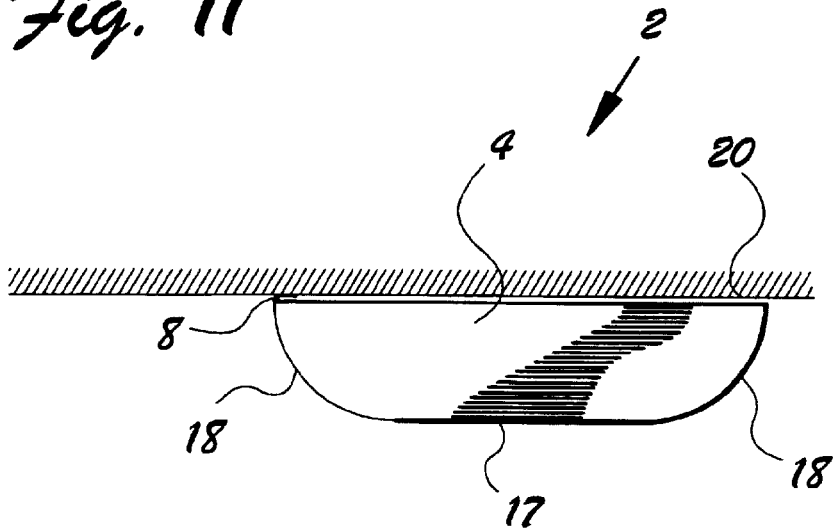
FIG. 11 is a top view of an alternate embodiment rotating shelf assembly incorporating a clam-shell rotating shelf array in the closed position, mounted to a wall.
Figure 12:
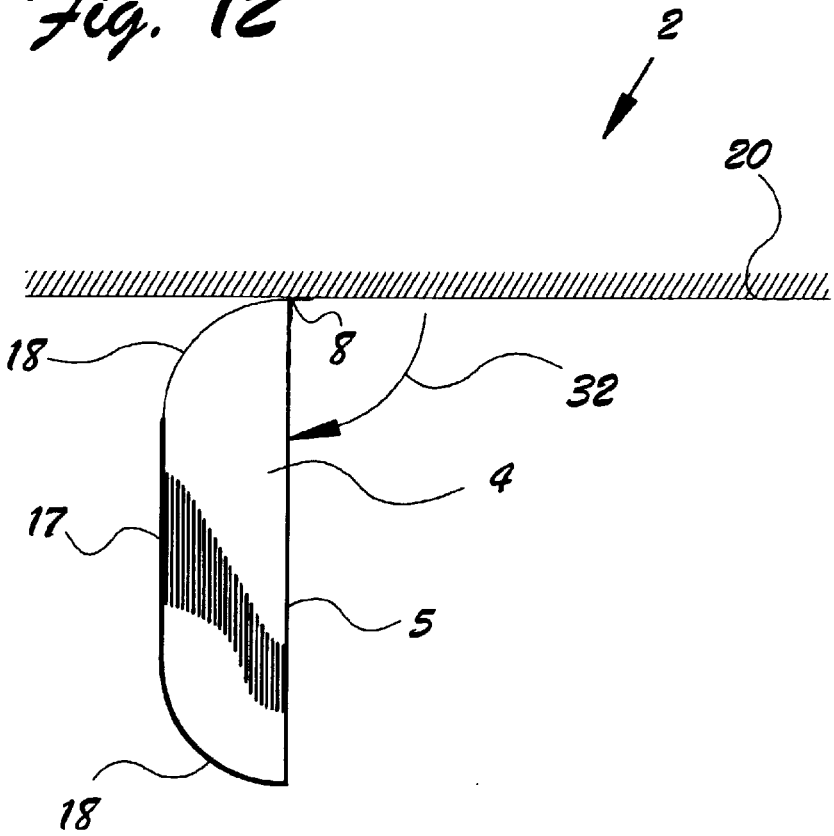
FIG. 12 is a top view of an alternate embodiment rotating shelf assembly incorporating a clam-shell rotating shelf array in the open position, mounted to a wall.

FIG. 11 is a top view of rotating shelf array 4 in the closed position. Rotating shelf array 4 is rotatably attached via hinges 8 to storage room wall 20 at a vertical edge of rotating shelf array curved back 18 opposite rotating shelf array flat back 17. This location of the hinged attachment between rotating shelf array 4 and storage room wall 20 permits rotating shelf array 4 to swing wide open for easy accessibility of adjustable shelves 10, as indicated by arrow 32 in FIG. 12.

The top view shape of rotating shelf array curved backs 18 is substantially an arc of a circle extending 90 degrees. Rotating shelf array 2 is positioned flush against storage room wall 20 for economy of space. The curved shape of rotating shelf array curved backs 18 affords clam-shell rotating shelf assembly 2 a sleek, streamlined appearance, and further contributes to the space-saving, small-footprint function and visual impression of rotating shelf assembly 2.

In the preferred embodiment, rotating shelf arrays 4 and base closet 6 were manufactured of wood, plastic, metal, or other appropriate material. Hinges 8 and handles 9 were off-the-shelf hardware.

While a preferred embodiment of the invention has been illustrated herein, it is to be understood that changes and variations may be made by those skilled in the art without departing from the spirit of the appending claims.

DRAWING ITEM INDEX

2 rotating shelf assembly
4 rotating shelf array
5 rotating shelf array mouth
6 base closet
7 base closet door
8 hinge
9 handle
10 adjustable shelf
12 arrow
14 rotating shelf array top
15 rotating shelf array floor
16 rotating shelf array side wall
17 rotating shelf array flat back
18 rotating shelf array curved back
20 storage room wall
21 storage room wall step
23 storage room wall step lip
22 storage room floor
24 air conditioning equipment
25 arrow
26 hot water heater
28 arrow
30 arrow
32 arrow

I claim:

1. A rotating shelf assembly comprising at least one rotating shelf array rotatably attached to a base closet, said base closet comprising two vertical side edges, said at least one rotating shelf array being rotatably attached to a corresponding said vertical side edge, said base closet being substantially parallel to a wall, said base closet being spaced away from said wall a distance substantially equal to a width of said rotating shelf array, said rotating shelf array comprising a rotating shelf array top, rotating shelf array floor, rotating shelf array side wall, and rotating shelf array curved back, said at least one rotation shelf array being rotatably attached to said base closet at an intersection of its rotating shelf array side wall and rotating shelf array curved back, edges of said rotating shelf array top, said rotating shelf array floor, said rotating shelf array side wall, and said rotating shelf array curved back defining a rotating shelf array mouth, and at least one adjustable shelf accessible through said rotating shelf array mouth, wherein a vertical position of said at least one adjustable shelf may be adjusted relative to said rotating shelf array floor and said rotating shelf array top, said rotating shelf array being disposed on an outside surface of said base closet. and wherein said rotating shelf array mounth is disposed adjacent said wall when said rotating shelf array is in a closed position.

2. The rotating shelf assembly of claim 1 wherein a top view of said rotating shelf array curved back is substantially an arc of a circle extending 90 degrees.

3. The rotating shelf assembly of claim 2 wherein said rotating shelf array further comprises a rotating shelf array flat back disposed between said rotating shelf array side wall and said rotating shelf array curved back, said at least one rotating shelf array is rotatably attached to said base closet at an intersection of its rotating shelf array side wall and rotating shelf array flat back, and wherein said rotating shelf array mouth is defined by edges opposite said rotating shelf array flat back of said rotating shelf array top, said rotating shelf array floor, said rotating shelf array side wall, and said rotating shelf array curved back.

4. The rotating shelf assembly of claim 1 wherein said at least one rotating shelf array comprises a handle disposed on said rotating shelf array curved back.

5. The rotating shelf array of claim 1 wherein said base closet further comprises at least one base closet door, wherein items behind said base closet may be accessed.

6. The rotating shelf assembly of claim 1 wherein said rotating shelf assembly comprises two rotating shelf arrays rotatably mounted on opposite vertical edges of said base closet.

7. An alternate embodiment rotating shelf assembly sized to be mounted against a storage room wall step, said rotating shelf assembly comprising a rotating shelf array, said rotating shelf array comprising a rotating shelf array top, rotating shelf array floor, rotating shelf array side wall, and rotating shelf array curved back, edges of said rotating shelf array top, said rotating shelf array floor, said rotating shelf array side wall, and said rotating shelf array curved back defining a rotating shelf array mouth, and at least one adjustable shelf accessible through said rotating shelf array mouth, wherein a vertical position of said at least one adjustable shelf may be adjusted relative to said rotating shelf array floor and said rotating shelf array top, a width of said rotating shelf array side wall being sized to substantially equal a width of said storage room wall step, said rotating shelf array being rotatably attached to a storage room wall step lip defined by an intersection of a storage room wall and said storage room wall step, said rotating shelf array being rotatably attached to said storage room wall step lip at an edge of said rotating shelf array side wall opposite said rotating shelf array mouth, said rotating shelf array being disposed on an outside surface of said step when said rotating shelf array is in a closed position, wherein said rotating shelf array mouth is disposed adjacent said wall when said rotating shelf array is in a closed position.

8. The rotating shelf assembly of claim 7 wherein a top view shape of said rotating shelf array curved back is substantially an arc of a circle extending 90 degrees.

9. The rotating shelf assembly of claim 7 wherein said rotating shelf array further comprises a rotating shelf array flat back disposed between said rotating shelf array side wall and said shelf array curved back, said at least one rotating shelf array is rotatably attached to said storage room wall step lip at an intersection of its rotating shelf array side wall and rotating shelf array flat back, and wherein said rotating shelf array mouth is defined by edges opposite said rotating shelf array flat back of said rotating shelf array top, said rotating shelf array floor, said rotating shelf array side wall, and said rotating shelf array curved back.

10. The rotating shelf assembly of claim 7 wherein said rotating shelf array further comprises a handle attached to said rotating shelf array curved back.

* * * * *